US007001093B2

(12) United States Patent
Rosso

(10) Patent No.: US 7,001,093 B2
(45) Date of Patent: Feb. 21, 2006

(54) COLLAPSIBLE PEN

(76) Inventor: Ron Del Rosso, 2098 Cliff Dr., Santa Barbara, CA (US) 93109

( * ) Notice: Subject to any disclaimer, the term of this patent is extended or adjusted under 35 U.S.C. 154(b) by 108 days.

(21) Appl. No.: 10/448,756

(22) Filed: Nov. 14, 2003

(65) Prior Publication Data

US 2004/0109719 A1 Jun. 10, 2004

Related U.S. Application Data

(63) Continuation-in-part of application No. 10/197,040, filed on Jul. 16, 2002, now abandoned.

(60) Provisional application No. 60/357,611, filed on Feb. 14, 2002.

(51) Int. Cl.
*B43K 23/02* (2006.01)
*B43K 23/08* (2006.01)

(52) U.S. Cl. ..... 401/131; 401/213

(58) Field of Classification Search ..... 401/117, 401/131, 243, 213, 222, 221, 202, 251, 99; 16/427, 429
See application file for complete search history.

(56) References Cited

U.S. PATENT DOCUMENTS 1,970,399 A * 8/1934 Shatkin ..... 401/95
2,035,378 A * 3/1936 Sayler ..... 401/251
4,380,403 A * 4/1983 Endres et al. ..... 401/213
4,659,125 A * 4/1987 Chuan ..... 294/19.2

* cited by examiner

*Primary Examiner*—David J. Walczak
(74) *Attorney, Agent, or Firm*—Michael G. Petit

(57) ABSTRACT

A collapsible pen including a telescopically extensible barrel and a ballpoint refill cartridge having a ballpoint tip removably attached to the barrel. The pen further includes a ballpoint tip cap that releasably attaches to the refill cartridge. The extensible barrel includes an outer tubular member and at least two and most preferably three inner tubular members concentrically and coaxially mounted with respect to both the outer tubular member and to one another. Each inner tubular member has a smaller outer diameter than the overlying tubular members. The ballpoint tip cap, adapted for attachment to a key chain, is releasably attached to either the outer tubular member of the barrel or to the refill cartridge to cover the ballpoint tip. The pen has a fully extended length and a collapsed (retracted) length. With a barrel consisting of three inner tubular members, and the cap removed, the fully extended length of the pen is greater than twice the collapsed length of the pen.

8 Claims, 5 Drawing Sheets

COLLAPSIBLE PEN

REFERENCE TO RELATED APPLICATIONS

The present application is a Continuation-in-Part of parent application Ser. No. 10/197,040, filed Jul. 16, 2002, now abandoned.

The present nonprovisional application is a Continuation in Part of U.S. Provisional Application Ser. No. 60/357,611, filed Feb. 14, 2002.

BACKGROUND OF THE INVENTION

1. Field of the Invention

The present invention relates generally to writing implements, and more particularly to a collapsible/extensible pen.

2. Prior Art

Pens that are collapsible or retractable to some portion of their fully extended length are known in the art. Representative of such pens are U.S. Pat. Nos. 3,174,461 and 3,709,620. Mittersinker et al., in U.S. Pat. No. 6,237,627, discloses an extensible pen having a pen barrel with an expanding middle section. The pen barrel holds a retractable ballpoint pen refill cartridge When the pen is expanded, the writing tip of the refill is extended from a retracted position inside the pen barrel to a writing position, while the barrel becomes full length for comfort when writing. The pen may be collapsed for storage, which simultaneously retracts the writing tip inside the pen barrel. The disclosure includes an embodiment wherein the pen includes a cap that is adapted for attachment to a key chain. Due to the construction of the pen, the fully extended length of the pen is necessarily less than two times its collapsed length.

Katoh, in U.S. Pat. No. 4,601,599, discloses a ball-point pen capable of being easily stored in a pocket or the like when not in actual use, and of being readily adjusted to a stand-by position for writing without the possibility of unexpected projection of the pen point. The ballpoint pen is provided with a telescopic body containing a ballpoint pen refill therein, and is constructed so that the pen point is hidden when the body is collapsed and that the pen point is exposed for writing when the body is extended. The ballpoint pen is further provided with retaining means for holding the body in the collapsed condition. When not in use, the ballpoint pen can be more conveniently stored in a pocket or the like if it is made shorter than prior art ones by collapsing the body. Since the body can securely be held in the collapsed state by the retaining means, the pen point is prevented from being unexpectedly exposed. The pen point can be exposed only by extending the body. In the extended state, the overall length of the pen is as long as the length of conventional, fixed-length prior art ballpoint pens. Again, however, due to the construction of the pen wherein the construction of the barrel has only two sliding members, the fully extended length of the pen is necessarily less than two times the collapsed length of the pen.

It is desirable to provide a pen that is truly compact: that is, a pen that can be collapsed to a length that is less than half of its fully extended length, have a fully extended length that is comfortable for writing and that may be attached to a key chain or necklace or the like when not in use. Most preferably, the collapsed length of the pen should be approximately the length of a key (~2.25 inches) so that it can be conveniently attached to a key chain, and have a fully extended length of about 5 inches—a length that is comfortable for writing.

SUMMARY

It is an object of the present invention to provide a collapsible pen that has a fully extended length and a collapsed length and which can be extended to a fully extended length that is greater than twice the collapsed length of the pen.

It is a further object of the invention to provide a collapsible pen meeting the above objective and having attachment means thereon operable for attaching the pen to a key chain.

It is yet a further object of the invention to provide a collapsible pen meeting both of the above-stated objectives and wherein the means for attaching the collapsible pen to a chain also securely covers the ink dispensing tip of the collapsible pen when the pen is not in use.

The above objects of the invention are met by providing a collapsible pen having a fully extended length and a collapsed length wherein said fully extended length is greater than or equal to said collapsed length. The collapsible pen comprises: (a) a tubular telescopically extendable barrel having a leading end and a trailing end; (b) a threaded barrel tip affixed to the leading end of the barrel; (c) a ballpoint pen refill cartridge adapted to be releasably attached to the threaded barrel tip; (d) a rear cap affixed to the trailing end of the barrel; and (e) a ballpoint refill cap having a leading end with chain attachment means thereon and a trailing end having a conical cavity therewithin and pen engagement means disposed within the conical recess. The barrel of the collapsible pen barrel comprises an outer tube having an axial bore and at least two axially concentric tubes coaxially and slidably disposed within the axial bore of the outer tube. The two axially concentric tubes comprise a first inner tube having a first axial bore and a second inner tube slidably and coaxially disposed within the first axial bore. The second inner tube preferably has a second axial bore. The threaded barrel tip affixed to the leading end of the outer tube comprising the barrel has a conical outer surface with a first annular groove thereon. The conical recess in the trailing end of the ballpoint refill cap has a second annular groove on an inner surface thereof and a compressible ring disposed within said second annular groove. The combination of the ring and grooves provides means for releasably but securely attaching the barrel to the cap. The cap includes means on the leading end thereof operable for attaching the cap to a chain or the like.

The features of the invention believed to be novel are set forth with particularity in the appended claims. However the invention itself, both as to organization and method of operation, together with further objects and advantages thereof may be best understood by reference to the following description taken in conjunction with the accompanying drawings in which:

DESCRIPTION OF THE PREFERRED EMBODIMENTS

Figure 1:
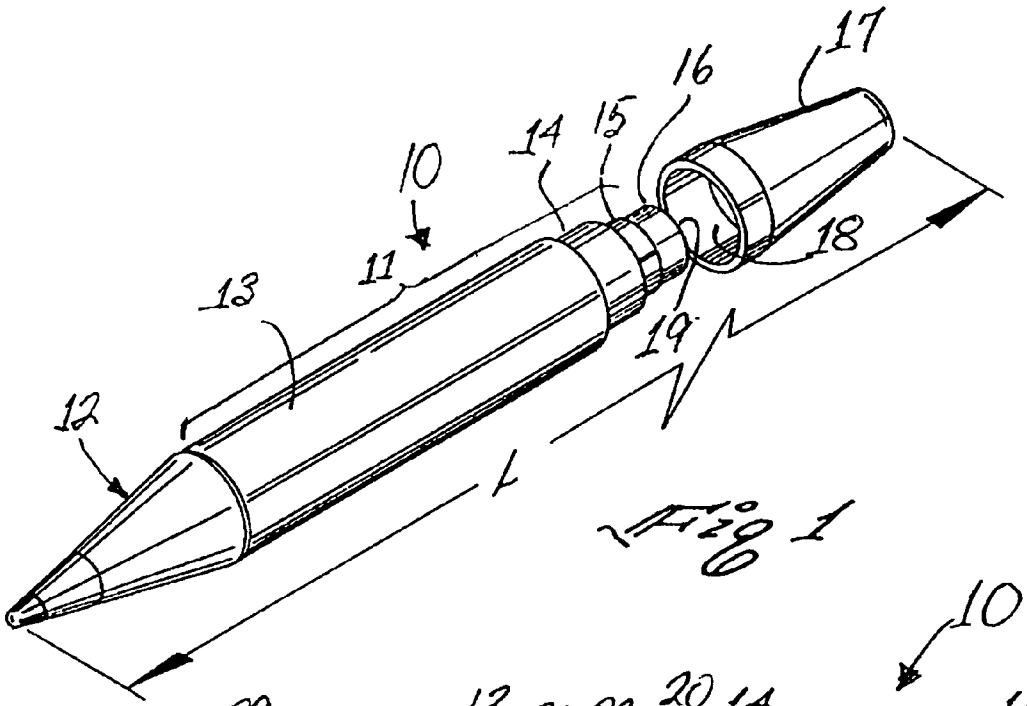
FIG. 1 is a partially exploded perspective view of a collapsible pen in accordance with the present invention with the pen in a collapsed position.

With reference to FIG. 1, a collapsible pen 10 in accordance with a first embodiment of the present invention is illustrated in perspective view. The pen 10 comprises a barrel 11 and a ballpoint refill 12 removably attached to the barrel 11. The barrel 11 comprises three or more concentric tubular members. The first embodiment of the pen 10 illustrated in FIGS. 1 and 2 has a barrel 11 comprising four tubular members. An outer tubular member 13 overlies coaxially disposed inner tubular members 14, 15 and 16 respectively. A rear cap 17 has a recess 18 therein, the rearmost portion of the recess 18 adapted to matingly and nonreleasably engage the trailing end 19 of inner tubular member 16.

Figure 2:
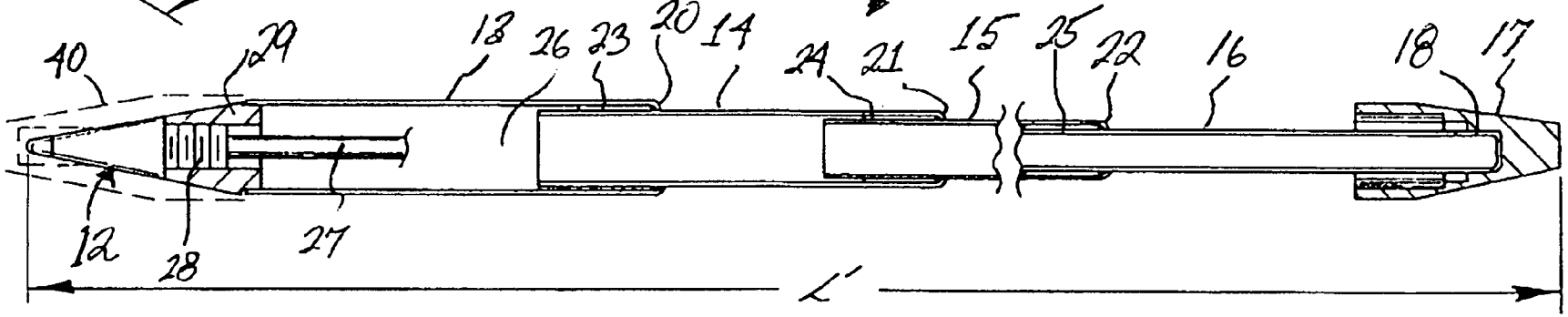
FIG. 2 is a side, partially cross-sectional view of the collapsible pen of FIG. 1 in a fully extended position.

Turning now to FIG. 2, the pen 10 is illustrated in partially cross-sectional side view in a fully extended configuration. The trailing end 20 of outer tubular member 13 is recurved inwardly as is the trailing ends 21 and 22 of inner tubular members 14 and 15 respectively. The leading ends 23, 24 and 25 of inner tubular members 14, 15 and 16 respectively are expanded at their respective outer diameters to prevent retraction of the respective inner tubular members from within the axial bore 26 of an overlying tubular member. The ballpoint refill 12 has a trailing end comprising an ink reservoir 27 that is housed within the axial bore 26 of the barrel 11. The ballpoint refill 12 has a threaded portion 28 adapted to matingly engage a threaded barrel tip 29 affixed to the leading end of the outer tubular member 13. The cylindrical recess 18 in the rear cap 17 is constricted in the rearmost portion thereof to friction fit over the trailing end of the innermost inner tubular member 16. The cylindrical bore comprising the forward end of the cylindrical recess 18 in the rear cap 17 has a diameter greater than or equal to the outer diameter of the outer tubular member 13.

Figure 3:
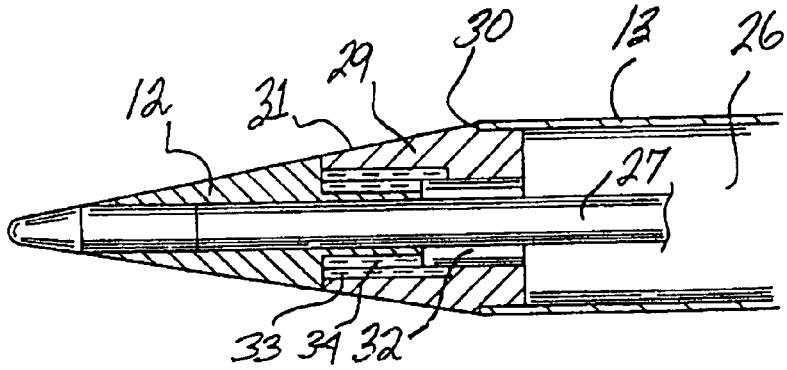
FIG. 3 is a partially cross-sectional view of the ballpoint tip of the pen of FIGS. 1 and 2 showing the relationship between the ballpoint refill and the outer tubular member comprising the barrel.

FIG. 3 is a detailed partially cross-sectional view of the ballpoint refill tip attached to the leading end 30 of the outer tubular member 13 by means of a threaded barrel tip 29 that is friction fit within the leading end of the axial bore 26 of the outer tubular member 13. The threaded barrel tip 29 enables the ballpoint refill 12 to be removed and replaced when the ink reservoir 27 is empty. The threaded barrel tip 29 has a conical outer surface 31 and an axial bore 32 dimensioned to enable the ink reservoir 27 to pass therethrough into the axial bore 26 of the outer tubular member. A threaded portion 33 of axial bore 32 is threaded to engage threads 34 on the ballpoint refill 12.

Figure 4:
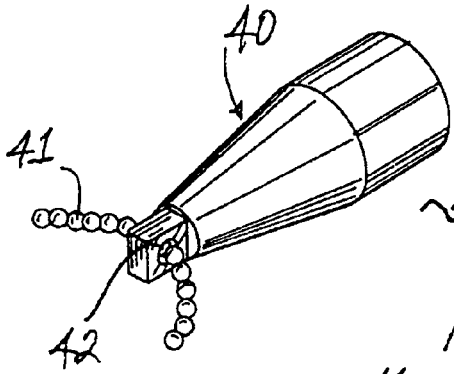
FIG. 4 is a perspective view of a cap adapted for releasable attachment to the ballpoint refill or the outer tubular member of the pen and to a key chain.

The collapsible pen 10 further preferably includes a removable cap 40, a first embodiment of which is shown in perspective view in FIG. 4. The first embodiment of the cap 40 has an inner recess with pen engagement means thereon (not visible in FIG. 4) operable for releasably engaging mating cap engagement means disposed on the outer surface of either the outer tubular member 13, or most preferably, the ballpoint refill 12 or the threaded barrel tip 29 of the collapsible pen 10. A fully assembled collapsible pen 10 attached to a key chain 41 by means of a hole 42 in the cap 40 is shown in perspective view in FIG. 5. Typical dimensions for a collapsible pen having an outer tubular member and three inner tubular members is collapsed length L=2.25", and the fully extended length L'=4.75". Thus the extended length L' of the pen 10 is greater than twice the collapsed length L' of the pen. The pen can also be dimensioned such that fully extended length is equal to the collapsed lenght.

Figure 5:
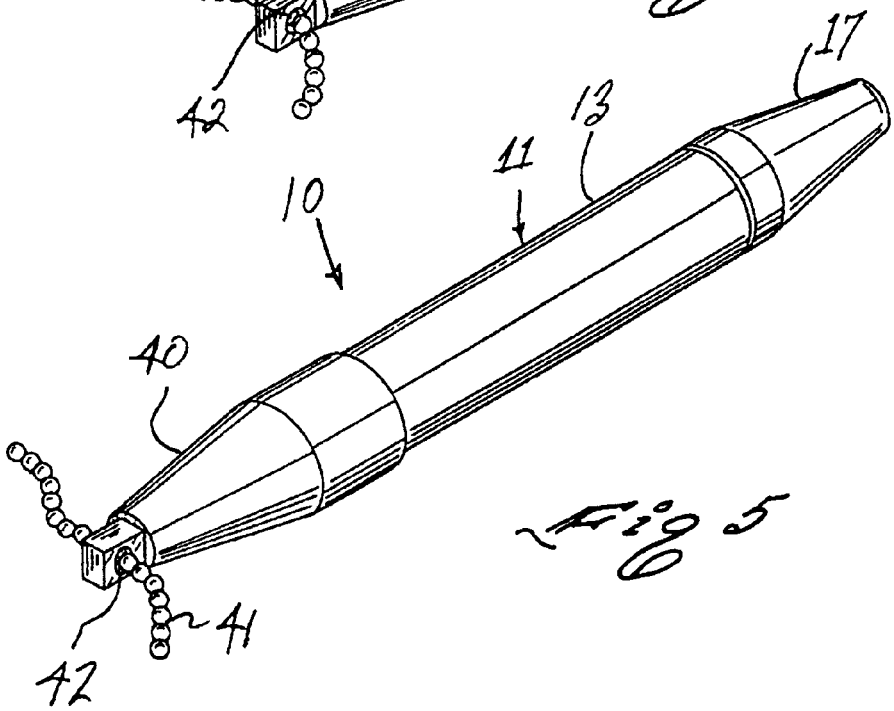
FIG. 5 is a perspective view of the collapsible pen in accordance with the present invention with the cap attached to a key chain and the pen in a fully collapsed configuration.
Figure 6:
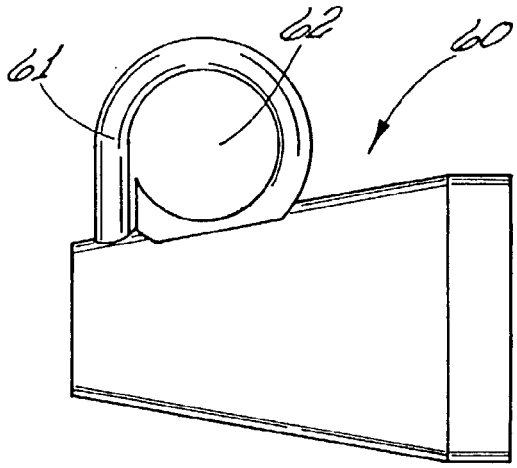
FIG. 6 is a side elevational view of a ballpoint tip cap adapted to be attached to a ring or chain in accordance with a preferred embodiment of the present invention.

FIG. 6 is a side elevational view of a preferred embodiment of a ballpoint tip cap 60 in accordance with the present invention that is adapted to be attached to a key ring or chain as shown at 41 in FIGS. 4 and 5. The cap 60 includes chain attachment means 61 having an aperture 62 therein dimensioned to accommodate a chain or ring passed therethrough. The chain attachment means 61 extends laterally from the cap 60 to reduce the overall length of the collapsible pen 10.

Figure 7:
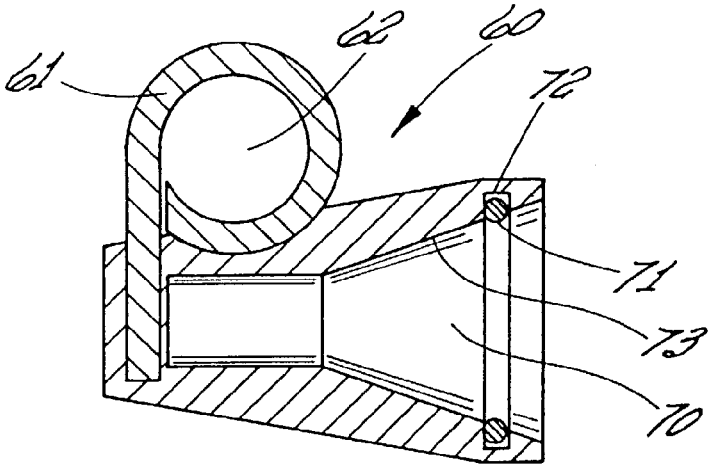
FIG. 7 is a longitudinal cross-sectional view of the preferred embodiment of the ballpoint tip cap of FIG. 6.

FIG. 7 is a longitudinal cross-sectional view of the preferred embodiment of the ballpoint tip cap 60 of FIG. 6. The cap 60 has a recess 70 with a conical inner surface 73 tapered to mate with the contour of the outer surface of the conical tip of the threaded barrel tip 29 and/or the ballpoint refill 12. The inner surface 73 of the conical recess 70 has an annular groove 72 circumscribed therein that houses a split, substantially circular, elastically extensible and/or compressible ring 71. The outer perimeter of the ring 71 is elastically extensible outwardly (i.e., deeper into the annular groove 72) when a radial, outwardly directed force is applied to the inner circumference of the ring 71. The ring 71 and groove 72 provide the cap 60 with pen releasable engagement means as will be discussed below.

Figure 8:
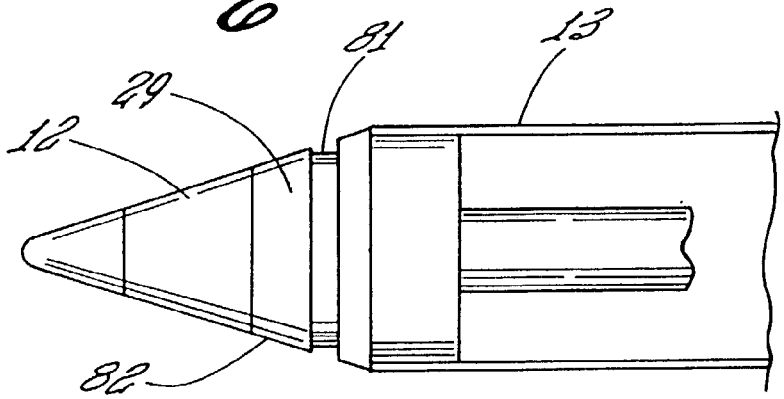
FIG. 8 is a partially cross-sectional view of the writing tip of a pen in accordance with a preferred embodiment of the present invention wherein the refill cartridge has an annular groove thereon adapted to matingly and releasably engage the ballpoint tip cap of FIGS. 6 and 7.

FIG. 8 is a partially cross-sectional view of the writing tip of a collapsible pen in accordance with a preferred embodiment of the present invention wherein either the threaded barrel tip 29 or the refill cartridge 12 has an annular groove 81 circumscribed thereon to matingly and releasably engage the elastically compressible ring 71 comprising the pen engagement means of the ballpoint cap 60 of FIGS. 6 and 7. When the conical ink-dispensing tip of the ballpoint refill 12 is inserted forcefully into the conical recess 70 within the cap 60, the conical outer surface 82 of the threaded barrel tip 29 (or the ballpoint refill) urges the ring 71 radially outward, deeper into the groove 72. Further advancement of the threaded barrel tip 29 into the recess 70 causes the ring 71 to expand into the annular groove 81 thereby releasably engaging the cap 60 to the threaded barrel tip 29. Subsequent retraction of the pen barrel 13 will compress the ring 71, forcing it into groove 72 and release the pen barrel from the cap. The ring 71 may be a compressible "O-ring" or, more preferably, a "C-ring" made from plastic or a, elastically deformable metal that is softer than the material comprising the conical outer surface of the threaded barrel tip 29 or the ballpoint refill 12.

The embodiment of the collapsible pen indicated at numeral 10 in FIGS. 1–5 has two disadvantages. First, it is difficult to manufacture a ballpoint refill cap attachment mechanism that retains its ability to releasably attach to the conical tip of the refill cartridge with prolonged, repetitive use with predictable reliability and holding strength. Second, due to the shape of the conical tip 12 of the ballpoint pen refill, it is difficult to grasp the tip 12 in order to unscrew the refill cartridge from the barrel 13 when the refill needs to be replaced.

Figure 9:
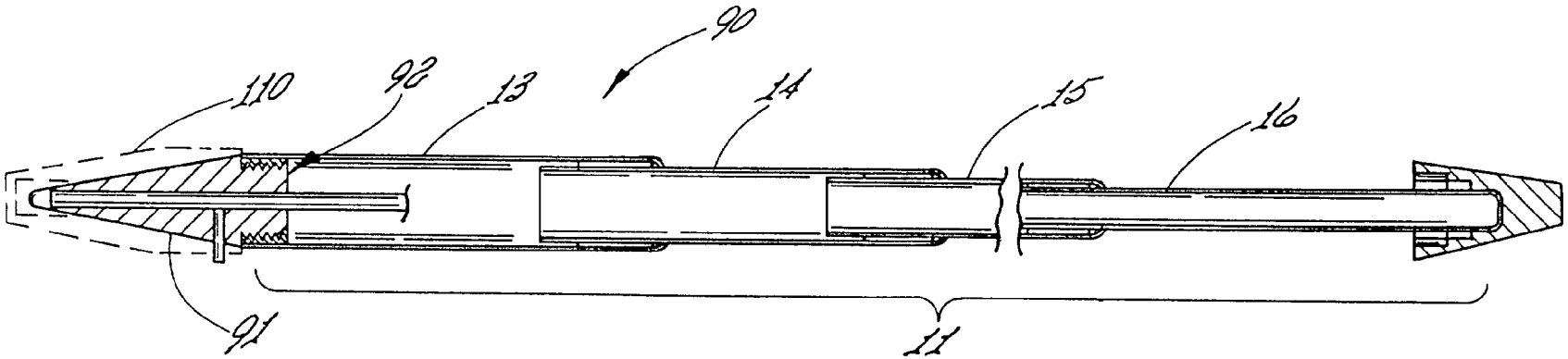
FIG. 9 is a longitudinal cross-sectional view of a most preferred embodiment of a collapsible pen in accordance with the present invention with the ballpoint refill cap generally illustrated with dashed lines.
Figure 10:
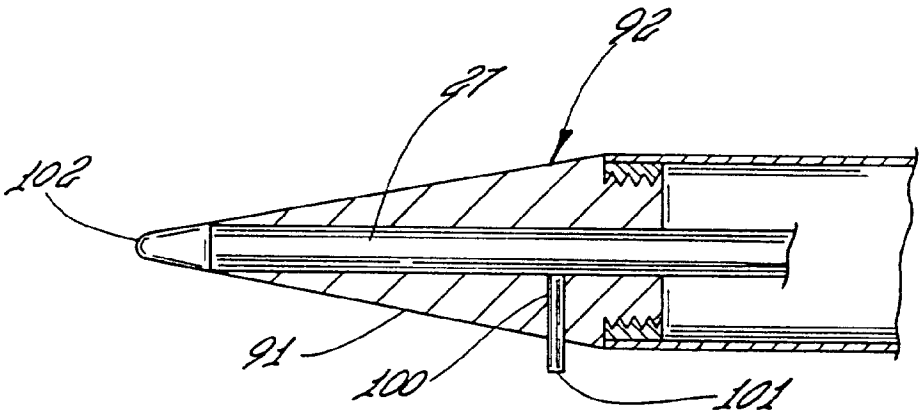
FIG. 10 is an enlarged longitudinal cross-sectional view of the leading end of the most preferred embodiment of the collapsible pen of FIG. 9 with the ballpoint refill cap removed.

FIG. 9 is a longitudinal cross-sectional view of a most preferred embodiment of a collapsible pen 90 in accordance with the present invention with the ballpoint refill cap generally illustrated with dashed lines. The most preferred embodiment 90 includes an improved attachment means for releasably attaching the ballpoint refill cap 110 to the conical tip 91 of a ballpoint pen refill 92.In the most preferred embodiment 90, both the refill cap 110 and the refill 92 have been modified to overcome the problems encountered with the embodiment 10 discussed above. FIG. 10 is an enlarged longitudinal cross-sectional view of the leading end of the most preferred embodiment of the collapsible pen of FIG. 9 with the ballpoint refill cap removed to expose the improved refill 91. A hole 100 is drilled into the conical outer surface 91 of the refill 92 and a detent pin 101 is inserted into the hole 100 and is held securely in the hole by a compression fit. The detent pin 101 projects laterally from the conical outer surface 91 of the refill tip in a direction that is orthogonal to the axis of the ink reservoir 27 comprising the refill 92.

Figure 11:
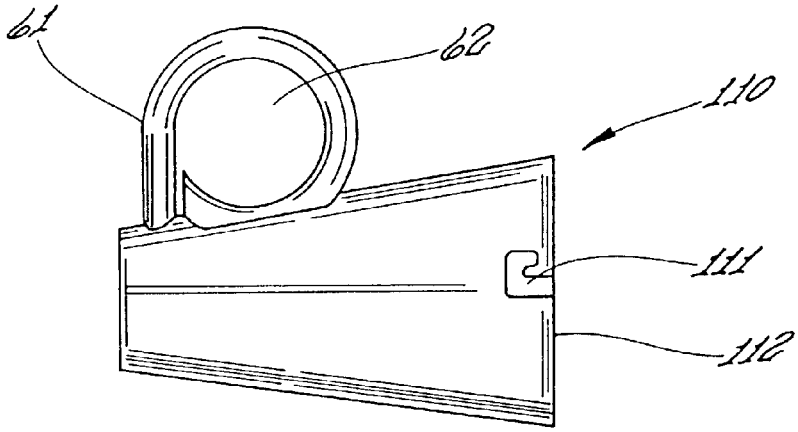
FIG. 11 is an elevational view of a ballpoint refill cap in accordance with the most preferred embodiment of the collapsible pen of the present invention illustrating the position of the J-shaped detent notch on the cap.

FIG. 11 is an elevational view of a ballpoint refill cap 110 adapted for use with the most preferred embodiment of the ballpoint refill 92 for the most preferred embodiment of the collapsible pen 90 of the present invention. FIG. 11 illustrates the position of the J-shaped detent notch 111 adjacent to and opening at the trailing end 112 of the ballpoint refill cap 110. The width of the notch 11 is slightly greater than the diameter of the detent pin 101.

Figure 12:
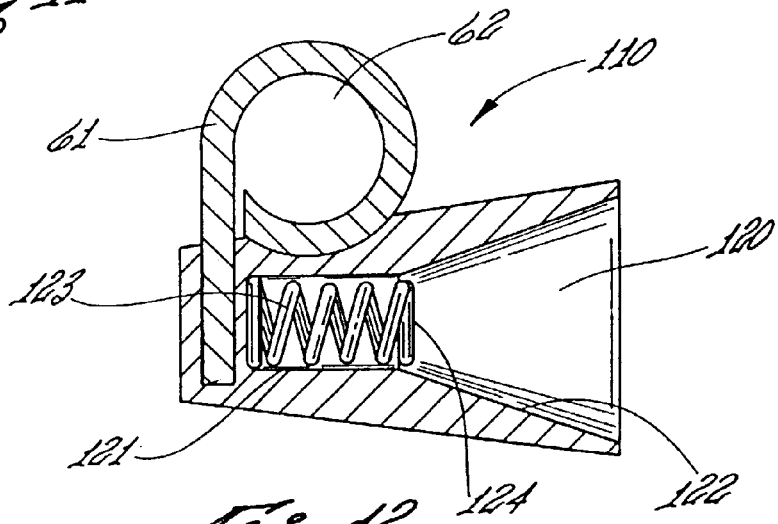
FIG. 12 is a longitudinal cross-sectional view of the ballpoint refill cap of FIG. 11 with a spring disposed in the cylindrical portion of the axial cavity.

FIG. 12 is a longitudinal cross-sectional view of the ballpoint refill cap 110 of FIG. 11 with a spring 123 disposed in the leading cylindrical portion 121 of the axial cavity 120. The trailing portion of the axial cavity has a conical surface as indicated at numeral 122. The trailing end 124 of the spring 123 is open and substantially circular. The leading end of the spring abuts the leading end of the cylindrical cavity 121 and is retained within the cylindrical cavity by compression. When the conical outer surface 91 rearward of the leading point 102 of the refill 92 (FIG. 10) is pressed against the spring 123, the spring compresses and the detent pin enters the J-shaped notch 11 until it can advance no further. A clockwise rotation of the refill 92 permits the detent to slide laterally through the notch until it is stopped from further rotation by contact with the return section of the notch 111. If the pressure is then released, the spring expands to lock the detent pin within the notch thereby securely fastening the cap 110 to the refill. Reversing the procedure releases the cap from the refill.

Figure 13:
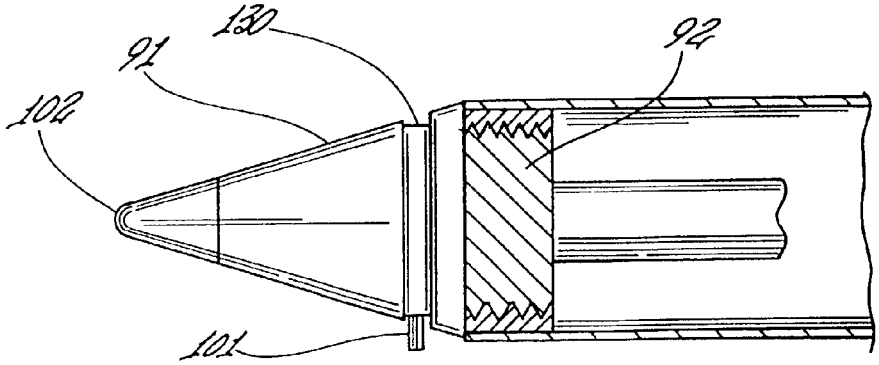
FIG. 13 is an enlarged longitudinal cross-sectional view of the leading end of the most preferred embodiment of a ballpoint pen refill for the collapsible pen of FIG. 9 with the ballpoint refill cap removed showing an annular groove machined into the conical outer surface of the refill to facilitate the drilling of a hole therein to receive a detent pin.

FIG. 13 is an enlarged longitudinal cross-sectional view of the leading end of the most preferred embodiment of a ballpoint pen refill for the collapsible pen of FIG. 9, with the ballpoint refill cap removed. The refill of FIG. 13 is similar to the refill of FIG. 10 except that an annular groove 130 is machined into the conical outer surface 91 of the refill 92 in order to facilitate the drilling of a hole therein to receive a detent pin 101.

The barrel 11 of all embodiments of the present collapsible pen includes a plurality of concentric cylinders 13–16 that are axially slidable with respect to one another. The inside diameter of each cylinder comprising the barrel is slightly larger than the outer diameter of the immediately underlying cylinder. Thus, the outermost cylinder comprising the barrel has the largest outer diameter and is dimensioned to be comfortably held between the fingers for writing. Unlike other collapsible pens, the removable ballpoint pen refill cartridge of the present pen is affixed to the outermost barrel for comfortable writing when the pen is extended to its full length and gripped between the fingers. Further, the replacement of the ballpoint pen refill is facilitated by the incorporation of a detent pin therein. The detent pin provides means for gripping the conical tip of the refill in order to unscrew it from the barrel for replacement. In addition, the cap 110 can be employed as a wrench to unscrew the refill from the barrel.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A collapsible pen having a fully extended length and a collapsed length wherein said fully extended length is greater than or equal to twice said collapsed length and wherein said collapsible pen comprises: (a) a tubular telescopically extendable barrel having a leading end and a trailing end wherein said leading end has a greater outer diameter than said trailing end when said barrel is extended; (b) a threaded barrel tip affixed to said leading end of said barrel; (c) a ballpoint pen refill cartridge adapted to be releasably attached to said threaded barrel tip; (d) a rear cap affixed to said trailing end of said barrel; and (e) a ballpoint refill cap having a leading end with chain attachment means thereon and a trailing end having a conical recess therewithin and pen engagement means disposed within said conical recess.

2. The collapsible pen in accordance with claim 1 wherein said barrel comprises an outer tube having an axial bore and at least two axially concentric tubes coaxially and slidably disposed within said axial bore of said outer tube.

3. The collapsible pen of claim 2 wherein said at least two axially concentric tubes comprise a first inner tube having a first axial bore and a second inner tube slidably and coaxially disposed within said first axial bore.

4. The collapsible pen of claim 3 wherein said second inner tube has a second axial bore.

5. The collapsible pen of claim 4 wherein said threaded barrel tip has a conical outer surface with a first annular groove thereon.

6. The collapsible pen of claim 5 wherein said conical recess in said ballpoint refill cap has a second annular groove on an inner surface thereof and a compressible ring disposed within said second annular groove.

7. A collapsible pen having a fully extended length and a collapsed length wherein said fully extended lenght is greater than or equal to twice said collapsed length, said collapsible pen comprising: (a) a tubular telescopically extendable barrel having a leading end and a trailing end; (b) a threaded barrel tip affixed to said leading end of said barrel; (c) a ballpoint pen refill cartridge adapted to be releasably attached to said threaded barrel tip; (d) a rear cap affixed to said trailing end of said barrel; and (e) a ballpoint refill cap having a leading end with chain attachment means thereon and a trailing end in opposition thereto, said ballpoint refill cap having an axial cavity therewhitin that is open at said trailing end, said axial cavity having a leading cylindrical portion with a spring disposed therewithin and a trailing conical portion and pen engagement means disposed on said ballpoint refill cap adjacent to said trailing end thereof, wherein said ballpoint refill cartridge has a conical outer surface on a leading end thereon and wherein a detent pin extends laterally from conical outer surface.

8. The collapsible pen of claim 7 wherein said pen engagement means on said ballpoint refill cap is a J-shaped detent notch on said trailing end thereof operable for matingly engaging said detent pin.

* * * * *